US007627994B1

(12) United States Patent
Demirkan

(10) Patent No.: US 7,627,994 B1
(45) Date of Patent: Dec. 8, 2009

(54) QUICK ANCHOR (UNIVERSAL POLE AND POST ANCHORING SYSTEM)

(76) Inventor: James R. Demirkan, 95 Keene Rd, Winchester, NH (US) 03470

( * ) Notice: Subject to any disclaimer, the term of this patent is extended or adjusted under 35 U.S.C. 154(b) by 198 days.

(21) Appl. No.: 11/811,639

(22) Filed: Jun. 11, 2007

Related U.S. Application Data

(60) Provisional application No. 60/812,179, filed on Jun. 10, 2006.

(51) Int. Cl.
*E02D 5/74* (2006.01)

(52) U.S. Cl. ..... 52/165; 248/530; 52/155

(58) Field of Classification Search ..... 248/530, 248/507, 909
See application file for complete search history.

(56) References Cited

U.S. PATENT DOCUMENTS

| | | | | | |
|---|---|---|---|---|---|
| 1,736,177 | A | | 11/1929 | Snook | |
| 3,342,444 | A | * | 9/1967 | Nelson | 52/165 |
| 4,248,025 | A | | 2/1981 | Kleine et al. | |
| 4,557,449 | A | | 12/1985 | Davidson et al. | |
| 4,793,110 | A | | 12/1988 | Tucker | |
| 4,923,165 | A | | 5/1990 | Cockman | |
| 5,039,043 | A | | 8/1991 | Hodge | |
| 5,060,435 | A | | 10/1991 | Bogdanow | |
| 5,066,168 | A | | 11/1991 | Holdeman | |
| 5,082,231 | A | * | 1/1992 | Knowles | 248/545 |
| 5,090,656 | A | * | 2/1992 | Brown | 248/545 |
| 5,123,623 | A | * | 6/1992 | McNamara | 248/545 |
| 5,307,598 | A | | 5/1994 | West | |
| 5,317,844 | A | | 6/1994 | Legler | |
| 5,568,909 | A | * | 10/1996 | Timko | 248/519 |
| 5,709,366 | A | * | 1/1998 | Speece | 248/530 |
| 5,984,587 | A | * | 11/1999 | Odle | 405/244 |
| 6,164,613 | A | | 12/2000 | Williams | |
| 6,202,369 | B1 | | 3/2001 | Partee et al. | |
| 6,328,273 | B1 | | 12/2001 | Kemikem | |
| 6,402,115 | B1 | * | 6/2002 | Groff et al. | 248/508 |
| 6,779,764 | B1 | * | 8/2004 | Gretz | 248/156 |
| 6,991,413 | B2 | | 1/2006 | Ballou et al. | |
| 7,152,841 | B2 | * | 12/2006 | Callies | 248/530 |

(Continued)

*Primary Examiner*—J. Allen Shriver, II
*Assistant Examiner*—Alaeddin Mohseni
(74) *Attorney, Agent, or Firm*—Luis Figarella

(57) ABSTRACT

Overall, this particular invention is a universal pole and post anchoring system used to support and stabilize various types of poles and well as posts while buried in the ground. What makes this particular invention very unique is that this anchoring system is simply molded as one piece device.

Figure 1:
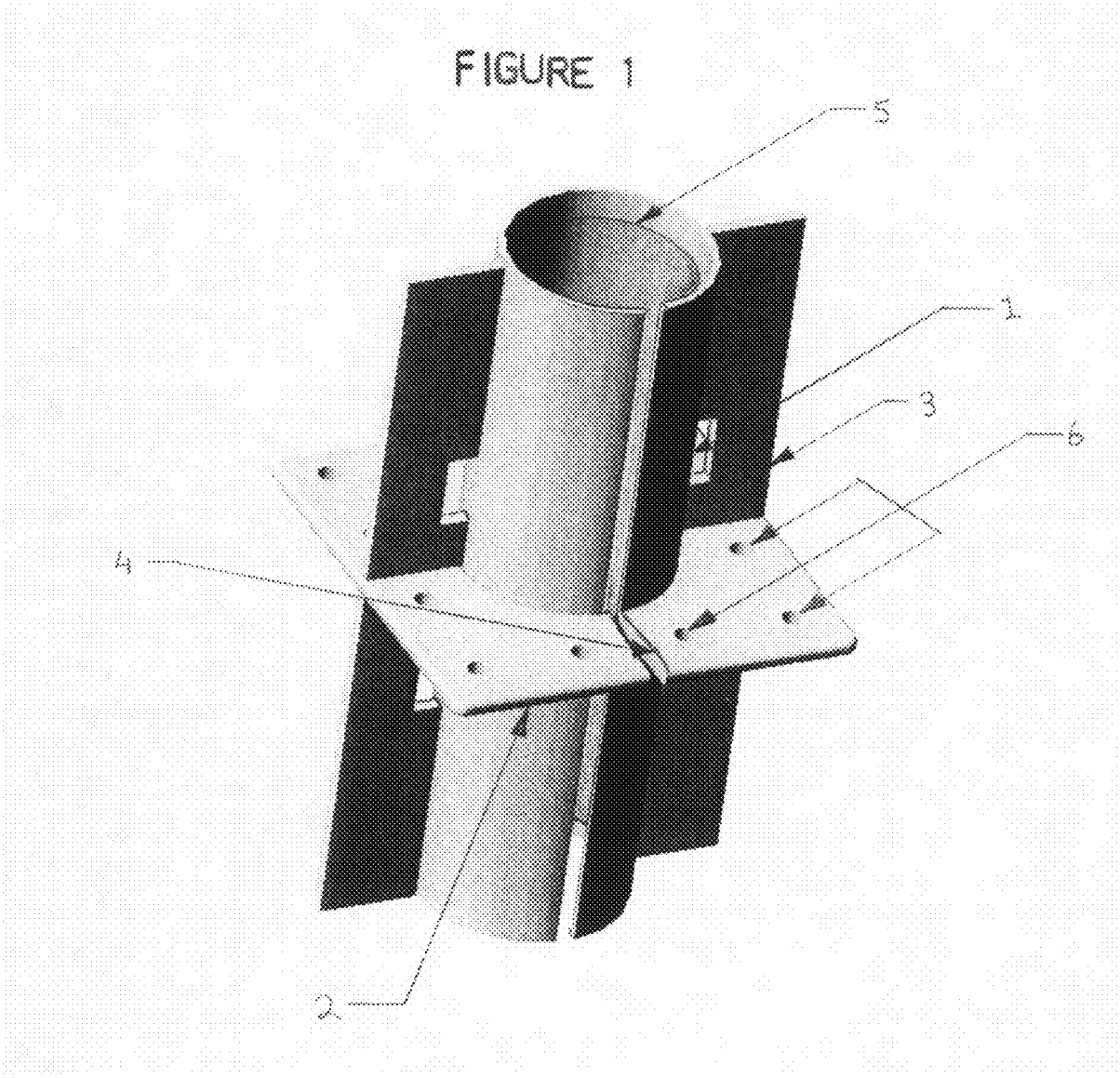
Figure 1:
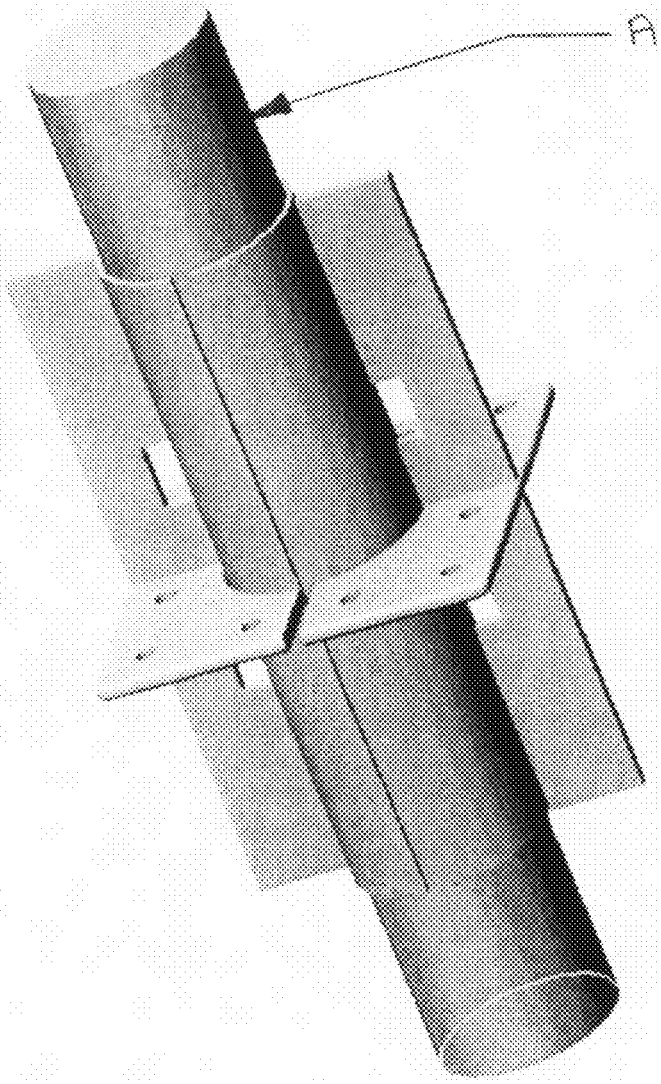

The pole or post would simply slip through this anchoring system with ease then secured with appropriate minimum of hand tools.

This invention is made of a one piece Strong and Light Polymer Plastic with various thicknesses or a one piece Metal Alloy material with various thicknesses.

This anchoring system, helps prevent any pole or post that is buried in the ground from leaning side to side as well as helping to prevent from accidentally being pulled off the ground or sink into the ground.

Depending on the size of the Poles and Posts being used, these anchoring systems do not require any special skills by consumers and require only minimum of hand tools for assembly such as a screw driver, or hammer and nails.

These anchoring systems could also be used in conjunction with cement or like material, or can be used without cement as a temporary solution.

1 Claim, 5 Drawing Sheets

U.S. PATENT DOCUMENTS 7,241,079 B2 * 7/2007 Francis ..... 405/231
7,380,561 B2 * 6/2008 Nobert et al. ..... 135/118
2002/0040957 A1 * 4/2002 Carter ..... 248/530
2004/0262486 A1 * 12/2004 Allen ..... 248/530
2005/0211866 A1 * 9/2005 Chambers ..... 248/507
2008/0017226 A1 * 1/2008 Nobert et al. ..... 135/16

* cited by examiner

QUICK ANCHOR (UNIVERSAL POLE AND POST ANCHORING SYSTEM)

This application claims the benefit of my Provisional Application No. 60/812,179 filed Jun. 10, 2006.

BACKGROUND ON THE INVENTION OF: QUICK ANCHOR (UNIVERSAL POLE/POST ANCHORING SYSTEM)

1. Background of the Invention

These two variations of the Universal Pole Anchoring Systems are provided for supporting devices of varying diameters as well as alternative lengths of Signage Posts, Satellites Poles, Utility Poles, Antenna Poles, Lamp Posts, Fence Posts, Porch Posts, Mail Box Posts, Trellises, to name a few. Of course, they can be used for various other applications as well.

2. DESCRIPTION OF PRIOR ART

As you can see, there have been various configurations of pole anchoring systems that have been designed in the past. But, over all, no other anchoring system comes close to or can be compared to this particular invention.

Among the past known patents for pole anchoring systems are as follows:

Snook, U.S. Pat. No. 1,736,177

Cockman U.S. Pat. No. 4,953,165

Tucker U.S. Pat. No. 4,793,110

Kemikem U.S. Pat. No. 6,328,273

Partee, Conner, Reagan U.S. Pat. No. 6,202,369

Holdeman U.S. Pat. No. 5,066,168

Ballou, McCue, Stevens U.S. Pat. No. 6,991,413

Williams U.S. Pat. No. 6,164,613

West, Ronald R. U.S. Pat. No. 5,307,598

West, Ronald R. U.S. Pat. No. 5,039,043

Hodge; Robert B U.S. Pat. No. 4,557,449

Legler, Steve U.S. Pat. No. 5,317,844

Bogdanow; Anatol L. U.S. Pat. No. 5,060,435

Kleine; Richard A. Byers; Warren J. U.S. Pat. No. 4,248,025

3. SUMMARY OF THE INVENTION

This particular invention is used as an improved stable support relative to the underlying foundation without needing the use of cement or like material, which can be very time consuming, dirty, and costly. But, a combination of these anchoring systems with cement or like material can also be used, should the need arise by the consumer. But otherwise, these anchoring systems should slip on to a pole or post with ease and then can be secured properly with appropriate minimum hardware. These anchoring systems also do not require any special skills and require only minimum of hand tools for assembly such as a screw driver or hammer and nails.

4. BRIEF DESCRIPTION OF THE (QUICK ANCHOR) POLE ANCHORING SYSTEM

This particular unit is made of either a Strong, but Light Polymer Plastic with various thicknesses or a Metal Alloy material, depending on the size, thickness, and the length of the Poles or Posts. This Unit can be assembled as a permanent fixture (with or without concrete cement) or it can be used as a temporary fixture (without concrete cement).

FIG. 1 Drawing is a perspective view of the (Quick Anchor) Pole Anchoring System. FIGS. 1-1 Drawing is a perspective view of a Pole (A), being held by the (Quick Anchor) Pole Anchoring System.

Figure 3:
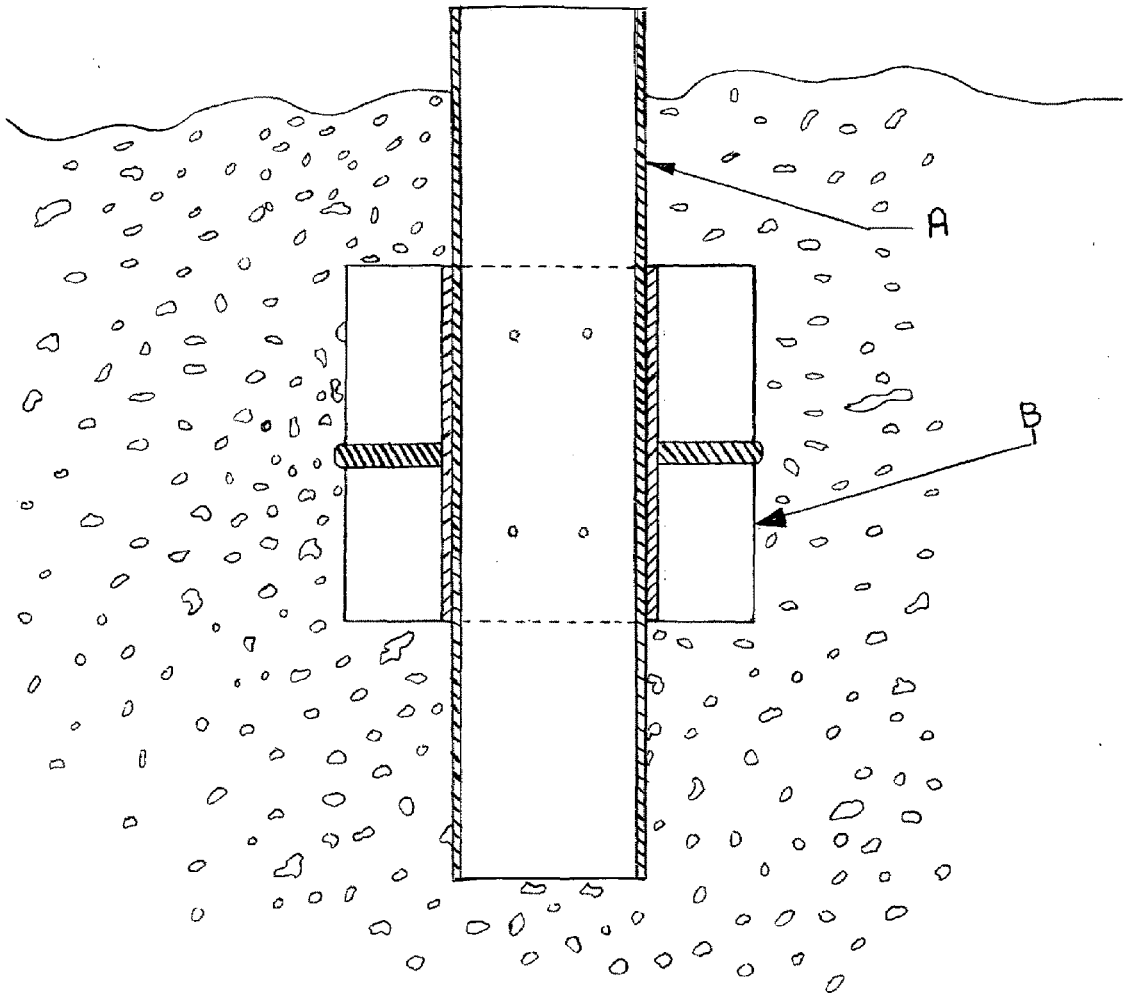

FIG. 3 Drawing is a cross section of a pole or post (A) being secured by the (Quick Anchor) Universal Pole and Post Anchoring System (B), buried in the ground.

5. DETAILED DESCRIPTION OF THE (QUICK ANCHOR) POLE ANCHORING SYSTEM DRAWING

A fuller understanding of the nature and objects of the present invention will be more apparent upon consideration of the following detailed description taken in connection with the accompanying drawings in (FIG. 1) and (FIGS. 1-1): The Slots through the Vertical Fins of the (Quick Anchor) Pole Anchoring System Drawing (FIG. 1, Number: 1) are made for the Clamp-On Straps or Cable Ties to go through these slots which are then fastened around the tube of the Pole Anchoring System once a pole is slid inside. Note: Cable Ties and Clamp on Straps will be supplied with the Pole Anchoring System. When this device is clamped on properly to the pole, the Base (FIG. 1, Number: 2) will help prevent the pole from coming off the ground as well as prevent it from sinking into the ground. When this device is clamped on properly to the pole, the Vertical Fins (FIG. 1, Number: 3) will also prevent the pole from rotating or leaning to one side. One side of the tube will have slit down through to the base (FIG. 1, Number: 4) so that it can be slightly be pulled apart by hand when a pole (FIG. 1-1A) is being slid through the tube before being fastened by the Clamp-On Straps or Cable Ties. Inside of tube (FIG. 1, Number: 5), will contain a thin rubber/foam padding to help the tube adhere to the pole to when the (Quick Anchor) Universal Pole Anchoring System is clamped on properly. There are series of holes that are drilled through the base of the (Quick Anchor) Universal Pole Anchoring System (FIG. 1, Number: 6). Once the pole is lowered and positioned in the ground, along with the (Quick Anchor) Universal Pole Anchoring System, it will be held more firmly into the ground once either dirt or cement is poured in through the holes of the base of the Anchoring System.

6. BRIEF DESCRIPTION OF THE (QUICK ANCHOR) POST ANCHORING SYSTEM DRAWING

This particular unit is also made of either a Strong, but Light Polymer Plastic with various thicknesses or by a Metal Alloy material, depending on the size, thickness, and the length of the Poles or Posts. This particular unit can also be assembled as a permanent fixture (with or without cement) or it can be used as a temporary fixture (without cement).

Figure 2:
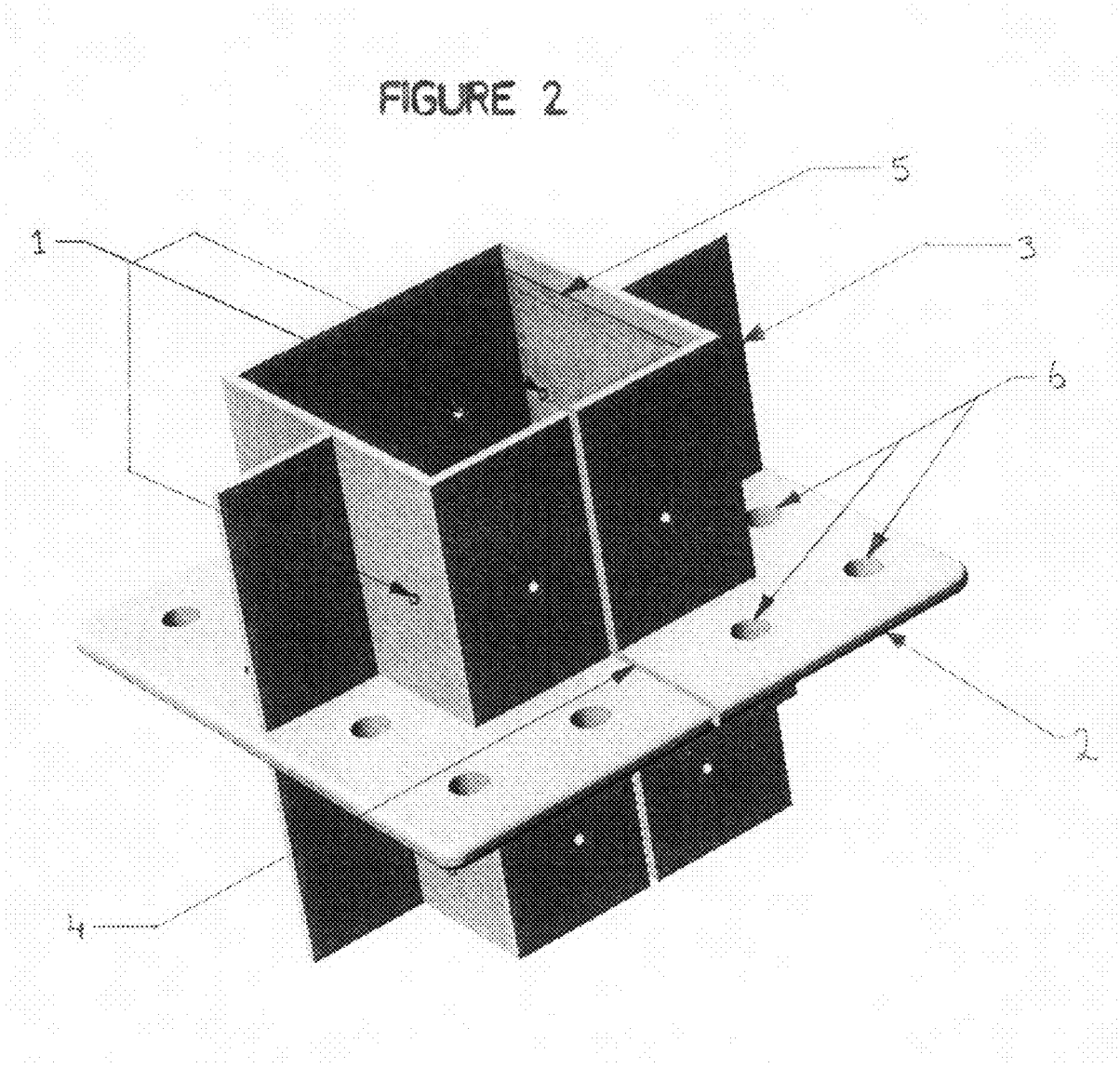
Figure 2:
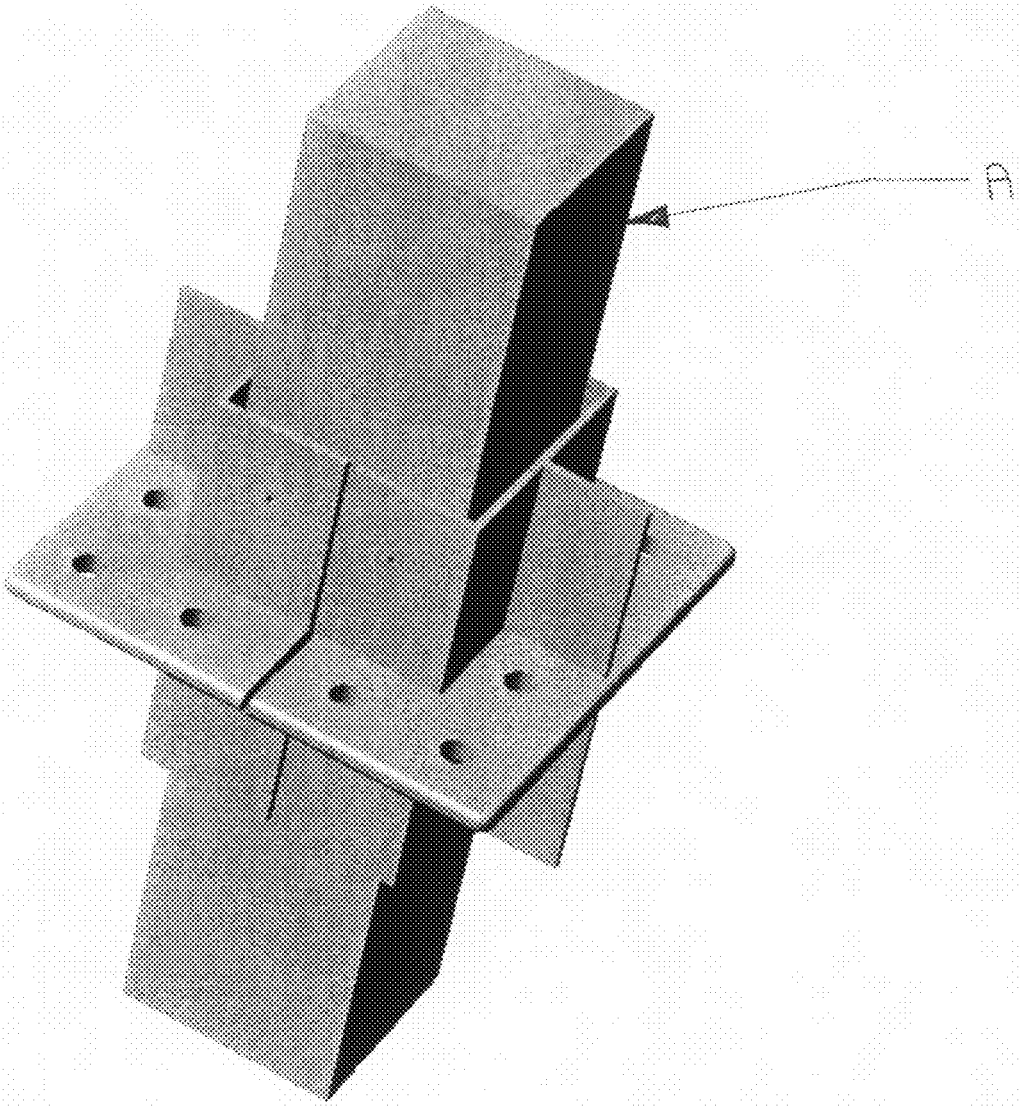

FIG. 2 Drawing is a perspective view of the (Quick Anchor) Pole Anchoring System. FIGS. 2-2 Drawing is a perspective view of a Post (A), being held by the (Quick Anchor) Post Anchoring System. FIG. 3 Drawing is a cross section of a pole or post (A) being secured by the (Quick Anchor) Universal Pole and Post Anchoring System (B), buried in the ground.

7. DETAILED DESCRIPTION OF THE (QUICK ANCHOR) POST ANCHORING SYSTEM DRAWING

A fuller understanding of the nature and objects of the present invention will be more apparent upon consideration of the following detailed description taken in connection with the accompanying drawings in (FIG. 2) and (FIGS. 2-2): The Holes through each Side of the Anchor (FIG. 2, Number: 1) are made for either Nails, Screws, or Rivets to be driven through to the post to hold the Anchor in place once the post is slid through and proper position has been set. Please Note: Screws and Rivets will be supplied with the Post Anchoring System. When this device is secured properly to the post, the Base (FIG. 2, Number: 2) will help prevent the post from coming off the ground as well as prevent it from sinking into the ground. When this device secured properly to the post, the Fins (FIG. 2, Number: 3) will also prevent the post from rotating or leaning to one side. One side of the tube will have slit down through the base (FIG. 2, Number: 4) so that it can be slightly be pulled apart by hand and the post (FIG. 2-2A), can slide easily through the Anchoring System before being fastened by Screws, Nails, or Rivets. Inside Anchoring System (FIG. 2, Number: 5), will contain a thin rubber/foam padding to help the Anchoring System adhere to the post to when secured by Nails, Screws, or Rivets.

There are series of holes that are drilled through the base of the (Quick Anchor) Universal Pole Anchoring System (FIG. 2, Number: 6). Once the pole is lowered and positioned in the ground, alone with the (Quick Anchor) Universal Pole Anchoring System, it will be held more firmly into the ground once either dirt or cement is poured in through these holes of the base of the Anchoring System.

What I claim:

1. An apparatus comprising;

a sleeve designed to tightly fit around the periphery of a post so that a portion of the post protrudes at both ends of said sleeve and the sleeve tightly grips the post, said sleeve having a slit along the side; and a thin rubber or foam padding inside the sleeve;

one or more substantially horizontal flat surfaces extending from said sleeve having surface area substantially greater than the cross-sectional surface of said post;

said horizontal surface having a slit, and one or more holes through each said horizontal flat surface;

and one or more vertical surfaces extending along portions of the sides of said sleeve; said vertical surfaces having one or more through openings near the body of the sleeve; one or more fasteners placed around the periphery of said sleeve and through the openings to tighten around the sleeve.

* * * * *